US005813057A

United States Patent [19]

Descent et al.

[11] Patent Number: 5,813,057

[45] Date of Patent: Sep. 29, 1998

[54] SELF-SANITIZING TOILET SEAT CLEANING APPARATUS

[75] Inventors: Jacques Descent; Jean Langevine, both of St. Petersburg, Fla.

[73] Assignee: Delan, Inc., St. Petersburg, Fla.

[21] Appl. No.: 931,929

[22] Filed: Sep. 17, 1997

[51] Int. Cl.[6] ..... A47K 13/00

[52] U.S. Cl. ..... 4/233; 4/223

[58] Field of Search ..... 4/233, 661, 237, 4/234, 222, 223, 224

[56] References Cited

U.S. PATENT DOCUMENTS

| | | | |
|---|---|---|---|
| 1,520,789 | 7/1924 | Weill . | |
| 3,599,246 | 8/1971 | Bramati | 4/233 |
| 3,837,018 | 9/1974 | Haberle . | |
| 4,536,899 | 8/1985 | Schnyder . | |
| 4,734,942 | 4/1988 | Blanchard . | |
| 4,790,036 | 12/1988 | Vogeli et al. | 4/233 |
| 5,022,097 | 6/1991 | Pusic | 4/233 |
| 5,119,517 | 6/1992 | Chang . | |
| 5,504,946 | 4/1996 | Keshiro . | |

FOREIGN PATENT DOCUMENTS

| | | |
|---|---|---|
| 52034 | of 1912 | Australia . |
| 214183 | 10/1909 | Germany . |

*Primary Examiner*—David J. Walczak
*Attorney, Agent, or Firm*—James E. Larson; Larson & Larson, P.A.

[57] ABSTRACT

A self-sanitizing toilet seat cleaning apparatus includes a seat in the shape of a generally circular ring that is rotatably mounted above the toilet bowl and includes a gear on its underside meshing with a pinion gear attached to the drive shaft of a drive motor for the seat. An arm extends over a rear portion of the seat and includes flow passages that convey a disinfectant on top of the seat, under the seat, and into the toilet bowl. Under the arm, a wiper is provided that wipes the top surface of the seat as it rotates. The toilet includes a weight sensor that stops rotation of the seat if a person is sitting on it and a proximity sensor to activate flushing of the toilet and rotation and disinfecting of the seat and bowl.

13 Claims, 5 Drawing Sheets

SELF-SANITIZING TOILET SEAT CLEANING APPARATUS

BACKGROUND OF THE INVENTION

The present invention relates to a self-sanitizing toilet seat cleaning apparatus. In the prior art, self-cleaning toilets are known. However, Applicant is unaware of any such device including all of the features and aspects of the present invention.

The following prior art is known to Applicant:

U.S. Pat. No. 1,520,789 to Weill

U.S. Pat. No. 3,837,018 to Haberle

U.S. Pat. No. 4,536,899 to Schnyder

U.S. Pat. No. 4,734,942 to Blanchard

U.S. Pat. No. 5,119,517 to Chang

U.S. Pat. No. 5,504,946 to Keshiro

Austrian Patent No. 52034 to Klier et al.

German Patentschrift No. 214183 to Langner.

None of these references taken alone or in combination teaches all of the aspects of the present invention including the combination of a rotary seat having a weight sensor, a proximity sensor to activate flushing and seat rotation, the dispensing of disinfectant above the seat, below the seat, and into the bowl, and the wiping of the top of the seat by a stationary wiping member.

SUMMARY OF THE INVENTION

The present invention relates to a self-sanitizing toilet seat cleaning apparatus. The present invention includes the following interrelated objects, aspects and features:

(1) In a first aspect, the inventive apparatus includes a bowl, a water tank and a seat mounted above the bowl in a manner allowing rotation of the seat with respect to the bowl but not lifting of the seat.

(2) The seat comprises a generally circular ring having a circular gear mounted on its underside, the gear having external circumferential teeth that are enmeshed with the gear teeth of a pinion gear mounted on the drive shaft of a drive motor.

(3) An arm overlies a rear portion of the seat with respect to the fixed location of the water tank and includes flow passages therethrough that are fluidly connected to a reservoir of disinfectant liquid with a pump interposed between the reservoir and the flow passages in the arm to facilitate controlled pumping of disinfectant through the arm as well as over the arm to allow disinfecting of the top and bottom surfaces of the seat, the bowl and a top surface of the arm itself. A stationary wiper member is mounted under the arm and is configured to engage the entire uniform cross-sectional surface of the seat so that as the seat rotates the seat is wiped.

(4) A weight sensor is interposed between the seat and the bowl and senses when a person is sitting on the seat. If the seat is rotating when a person sits down thereon, rotation is stopped. When a person is sitting on the seat, the weight sensor prevents the seat from beginning its treatment cycle.

(5) A proximity sensor is mounted on an upper portion of the water tank and may, for example, comprise a photoelectric "eye" that senses proximity of a hand or other object and, responsive to such proximity, commences the flushing and treatment cycle, provided the weight sensor does not sense presence of a person on the seat.

A timer may be provided to time a prescribed time period after the weight sensor senses that a user has left the toilet, so that if the proximity sensor is not "tripped" within the prescribed time period, the apparatus controller will automatically activate the flushing and treatment cycles.

As such, it is a first object of the present invention to provide a self-sanitizing toilet seat cleaning apparatus.

It is a further object of the present invention to provide such an apparatus including a proximity sensor allowing activation of flushing and treatment cycles without touching of a flush handle.

It is a still further object of the present invention to provide such an apparatus including an arm conveying disinfectant above and below the seat as well as over the arm and into the toilet bowl.

It is a still further object of the present invention to provide such an apparatus including a wiper mounted under the arm and designed to wipe the top surface of the seat as it rotates with respect thereto.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1A:
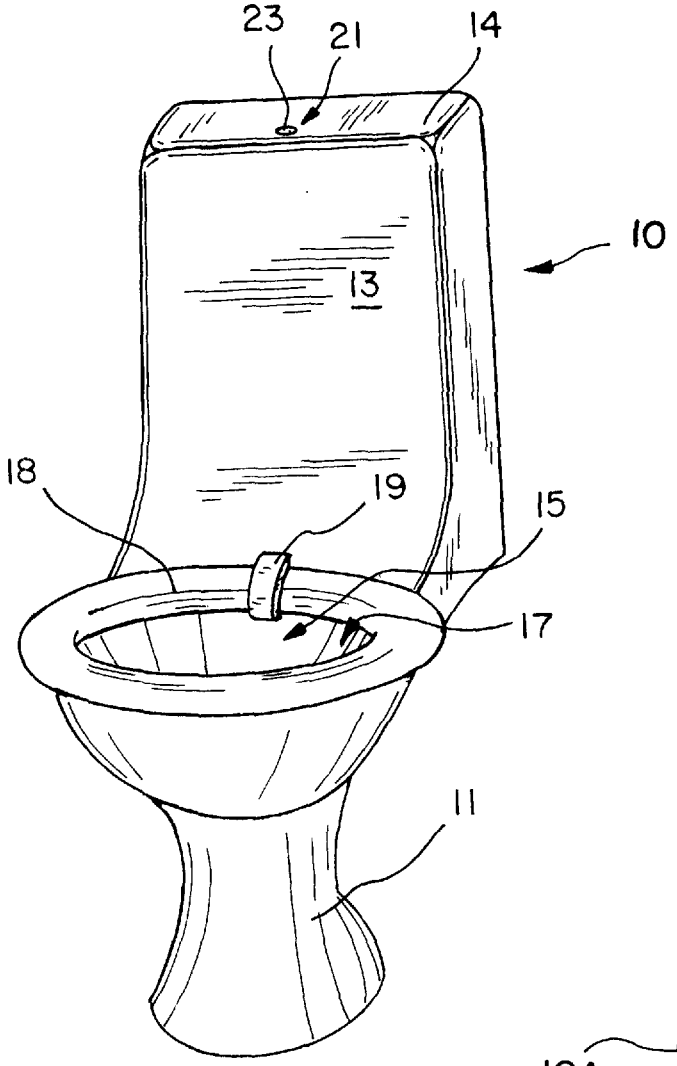
FIG. 1A shows a front perspective view of the inventive apparatus.

With reference, first, to FIG. 1, the present invention is generally designated by the reference numeral 10 and is seen to include a base 11, a tank 13, and a bowl 15 on which is rotatably mounted a seat 17. An arm 19 extends forwardly from a lower portion of the tank 13 and protrudes over the seat 17 in the manner shown. A proximity sensor 21 includes a photoelectric "eye" 23 that shines upwardly from a top surface 14 of the tank 13 in the manner shown in FIG. 1. The seat 17 includes a top surface 18 as shown in FIG. 1.

Figure 2:
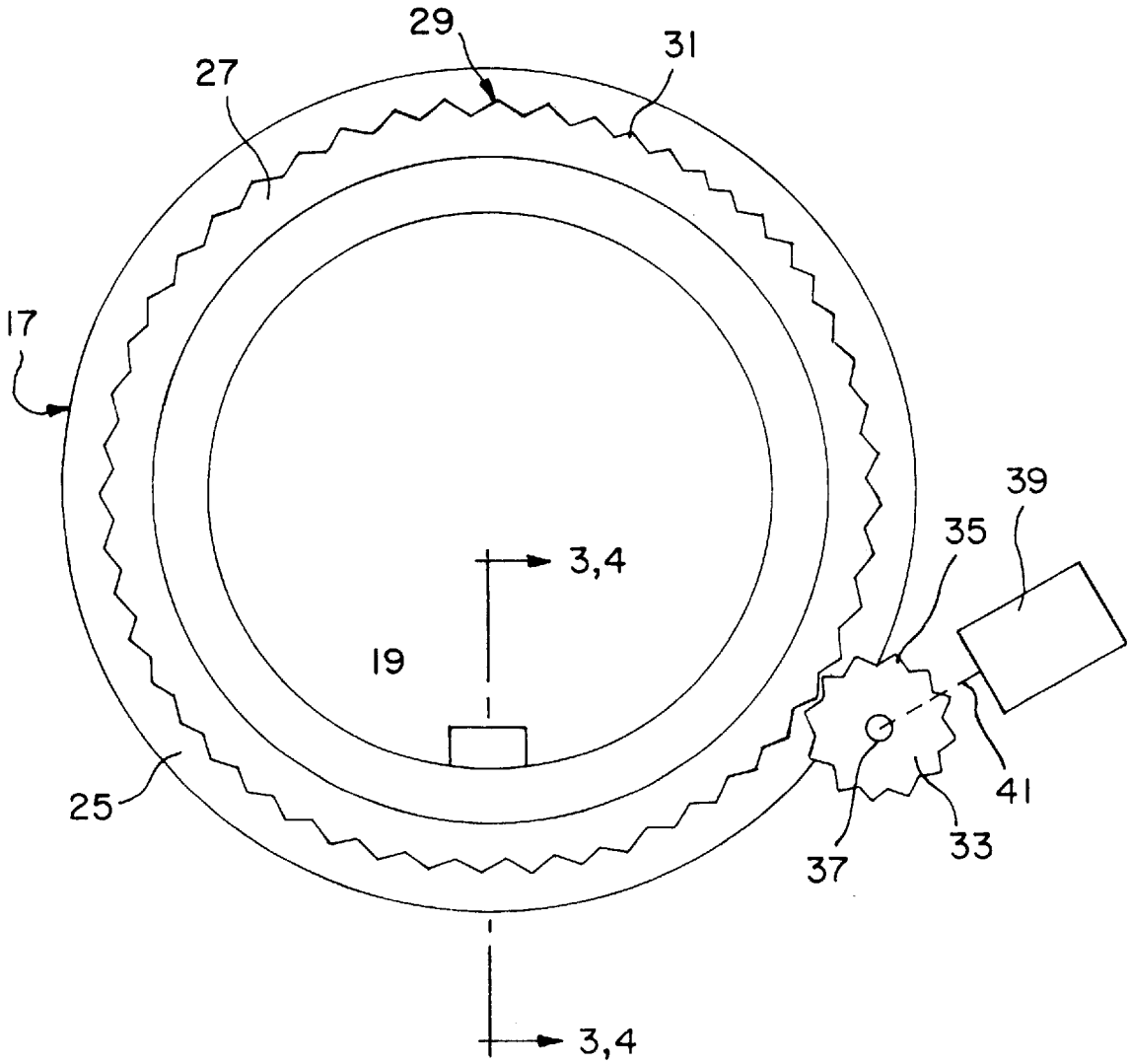
FIG. 2 shows a view looking upward from the underside of the seat of the inventive apparatus with portions thereof removed to show detail.

With reference to FIG. 2, it is seen that the seat 17 also includes an undersurface 25 on which is mounted a ring 27 having an outer periphery 29 that includes a multiplicity of circumferentially spaced gear teeth 31. The gear teeth 31 enmesh with the gear teeth 35 of a pinion gear 33 that includes a central opening 37 permitting the gear 33 to be mounted on the drive shaft 41 of a drive motor 39 wherein the motor may be mounted within the tank, controlled in a manner to be described in greater detail hereinafter.

Figure 3:
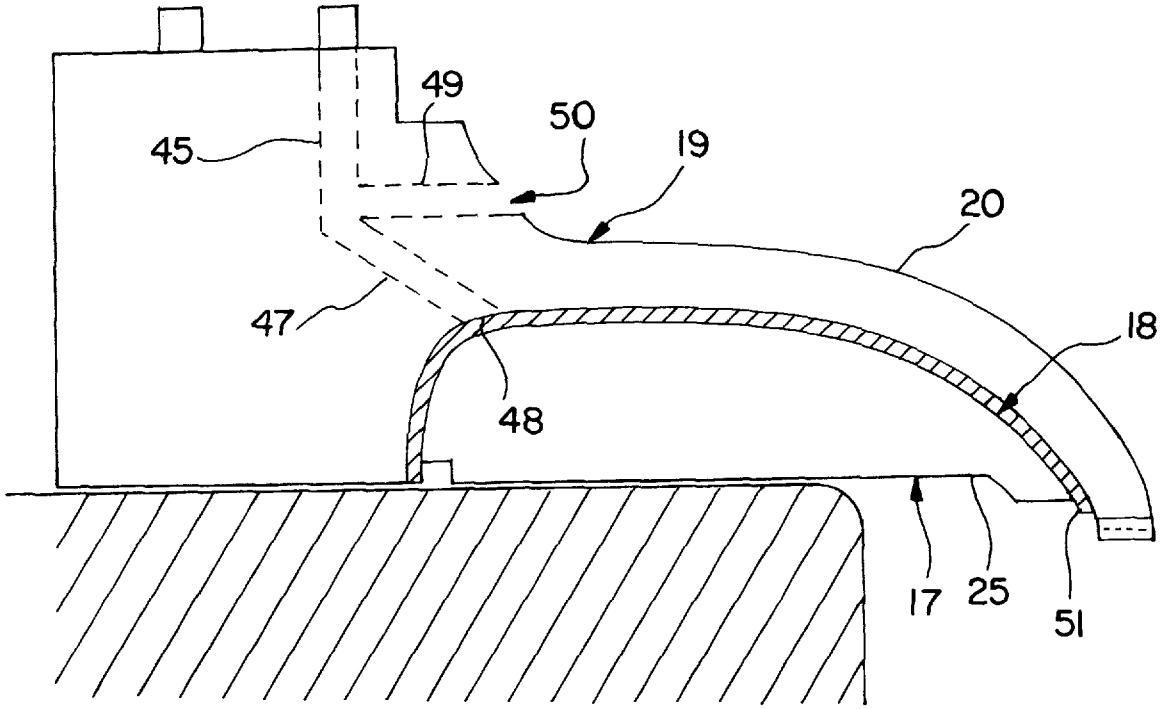
FIG. 3 shows a cross-sectional view along the line 3—3 of FIG. 2.
Figure 4:
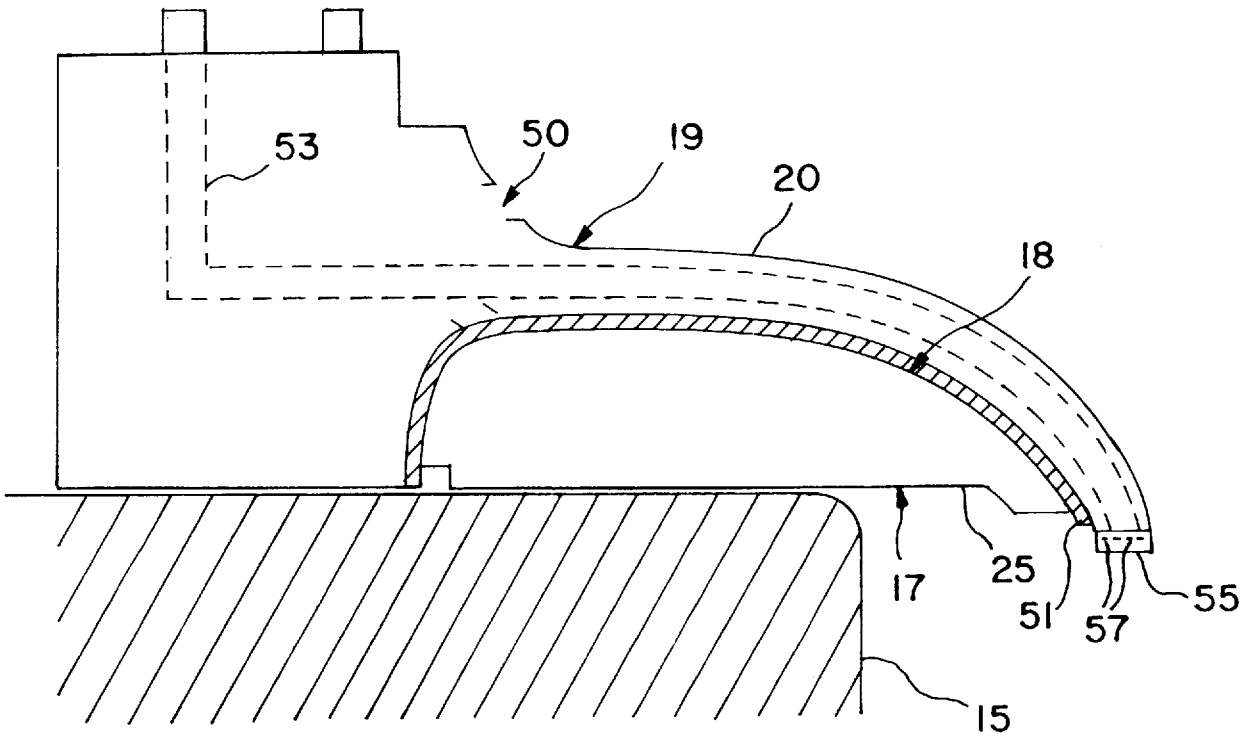
FIG. 4 shows a cross-sectional view along the line 4—4 of FIG. 2.

With reference, now, to FIGS. 3 and 4, the interaction between the arm 19 and the seat 17 will be described in greater detail. As seen in FIG. 3, the arm 19 includes a first internal fluid passageway 45 that branches into downstream branches 47 and 49, with the branch 49 intended to convey disinfectant to an exit 50 where the disinfectant will spill over the top surface 20 of the arm to disinfect the surface 20.

The branch 47 includes an exit 48 that allows disinfectant fluid to be sprayed over the top surface 18 of the seat 17.

With reference to FIG. 4, the arm 19 also includes a second flow passage 53 that extends within the arm 19 to a distal outlet nozzle 55 having a multiplicity of laterally directed ports 57 that allow spraying of disinfectant, not only within the bowl 15 but also onto the undersurface 25 of the seat 17.

As seen in FIGS. 3 and 4, a wiper 51 is mounted on the undersurface of the arm 19 and closely matches the contours of the upper surface 18 of the seat 17. Thus, when the seat 17 is caused to rotate with respect to the fixed arm 19, the entire surface 18 of the seat 17 is wiped by the wiper 51 in a similar manner to the operation of a "squeegee".

Figure 5:
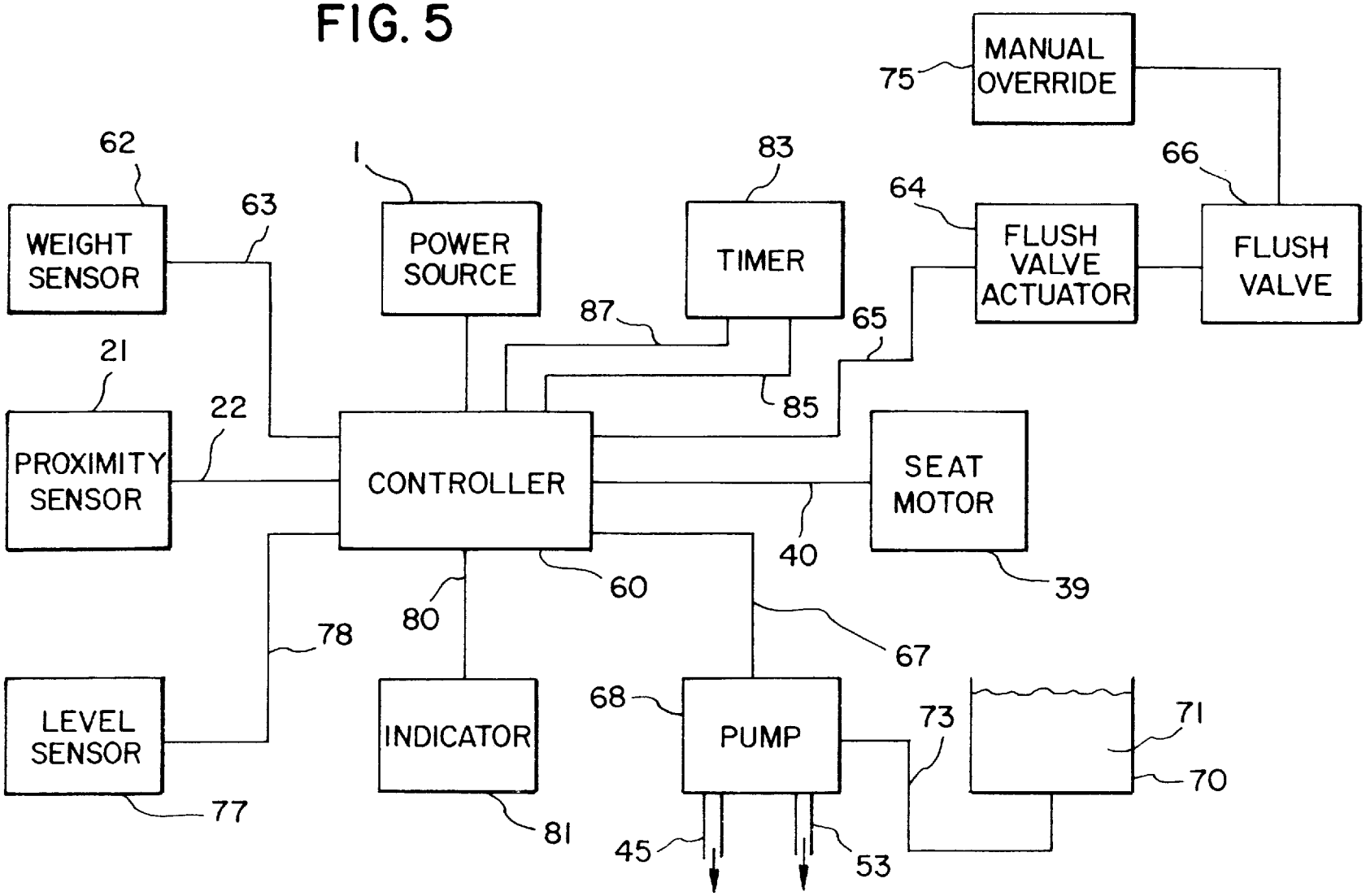
FIG. 5 shows a schematic representation of the electrical circuitry of the present invention.

With reference to FIG. 5, the electrical circuitry of the present invention will now be described. At the heart of the present invention is actuator means comprising a controller 60 which may be located within the tank, comprising a microcomputer that is preprogrammed to receive signals from various sensors and, responsive thereto, to operate the system. Thus, the weight sensor 62 is interposed between the seat 17 and a top lip of the bowl 15 and senses when a person is sitting on the seat. The weight sensor 62 may be preprogrammed so that any weight greater than, for example, 20 pounds, will result in a signal being sent to the controller via the conductor 63 so that the controller 60 will be informed that someone is sitting on the seat 17.

When the proximity sensor 21 senses a hand or other object in close proximity to the photocell 23 thereof, a signal is sent to the controller via the conductor 22 and the controller 60, responsive thereto, will activate the seat motor 39 to cause rotation of the seat 17 in the manner explained above with reference to FIG. 2 and will activate the flush valve actuator 64 via the conductor 65 to cause the flush valve 66 to be activated to cause flushing of the bowl 15.

Concurrently, the pump 68 is activated via a signal from the controller 60 via the conductor 67 to cause disinfectant 71 contained within the reservoir 70 which may be located within the tank, to be pumped via the fluid conduit 73 through the pump 68 and into the flow passages 45 and 53 contained within the arm 19 as explained above with reference to FIGS. 3 and 4. If the system is "down", the manual override 75 may be employed to activate the flush valve 66. The manual override 75 may, if desired, merely comprise a flushing handle such as is normally found on a typical toilet, but hidden from view and accessible through an access panel (not shown) only when access is necessary.

The level sensor 77 may sense the level of disinfectant fluid 71 within the reservoir 70 and when the level is below a preprogrammed minimum level, a signal may be sent to the controller 60 via the conductor 78 so that the controller 60 will send a signal to the indicator 81 via the conductor 80 to cause activation of a display indicative that the reservoir 70 must be filled.

Furthermore, the controller 60 is programmed so that the flush valve actuator 64 and pump 68 will not operate so long as the weight sensor 62 is indicating that a person is sitting on the seat 17. Under such circumstances, the controller 60 is also preprogrammed to ignore indications comprising signals from the proximity sensor 21 so long as the weight sensor 62 is indicating a weight on the seat 17.

If desired, a timer 83 may be provided. In this regard, when the weight sensor 62 stops sending a signal through the conductor 63, indicative that a person has stepped away from the seat 17, the timer 83 may be activated by the controller via the conductor 85 to start a timing period of, for example, 30 seconds. If, during the 30 second period, the proximity sensor 21 does not send a signal to the controller 60 via the conductor 22 to activate the flushing and disinfecting cycle, after the prescribed time period, the timer 83 will send a signal to the controller 60 via the conductor 87 signaling the controller 60 to automatically activate this sequence.

One preferred mode of operation of the present invention contemplates programming of the controller so that when the proximity sensor 21 senses proximity of a hand or other object to thereby activate the flushing and disinfecting sequence, the seat motor 39 is activated to rotate the seat 17 through two complete revolutions, each one of which may take, for example, 8 seconds. During the first revolution of the seat 17, the pump 68 is also activated causing continuous spraying of disinfectant through the flow passages 45 and 53 and out the outlets 48 and 50 and the nozzle 55 to cause thorough spraying of the top surface 20 of the arm 19, of the upper surface 18 of the seat 17, of the undersurface 25 of the seat 17, and of the inner surfaces of the bowl 15. After the first 8 second period has concluded, the controller 60 stops the operation of the pump 68 and the seat 17 continues rotation for one additional complete revolution thereby causing the wiper 51 to thoroughly wipe and dry the upper surface 18 of the seat 17.

In the preferred embodiment of the present invention, the power source 1 schematically depicted in FIG. 5 may, if desired, comprise a 12 volt battery, or a transformer receiving household 110 VAC power and converting it to 12 volts DC to run the controller 60 and the other components of the present invention. Of course, any other alternative source of electrical power that can be integrated into the inventive electrical circuitry as schematically depicted in FIG. 5 may be employed.

Figure 1B:
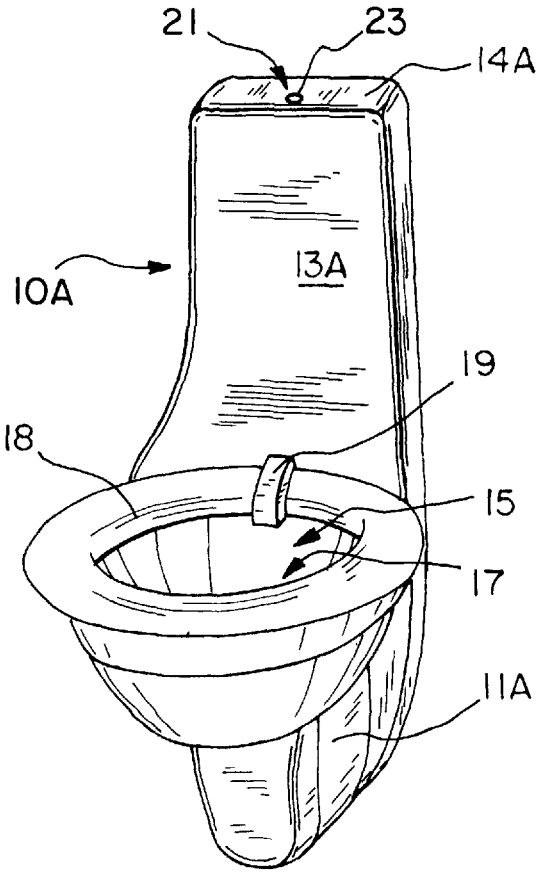
FIG. 1B shows a front perspective view of an alternate embodiment of the inventive apparatus.

While the present invention is depicted in the drawing figures as including a body having a base 11 adapted to be supported on a floor surface, of course, if desired, the base 11 may be of a structure allowing it to be wall-mounted as shown in FIG. 1B. In this alternate structure the base 11A is mounted to a vertical wall and tank 13A and top surface 14A have a more narrow geometric configuration.

As such, an invention has been disclosed in terms of a preferred embodiment thereof which fulfills each and every one of the objects of the invention as set forth hereinabove and provides a new and useful self-sanitizing toilet bowl cleaning apparatus of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A self-sanitizing toilet seat cleaning apparatus for a toilet having a flushing mechanism, comprising:

a) a base having a bowl and a seat rotatably mounted above said bowl wherein the base is connected to an upright tank;

b) a motor mounted in said upright tank and having a rotary drive shaft coupled to said seat whereby rotations of said drive shaft rotate said seat;

c) an arm extending from said tank and overlying said seat, said arm having a flow passage therethrough adapted to convey disinfectant liquid onto said seat and into said bowl;

d) a reservoir of disinfectant liquid in said upright tank and fluidly connected to said flow passage via a pump;

e) a wiper mounted under said arm and having a wiping surface configured in conformity with an upper surface of said seat;

f) a weight sensor sensing a weight on said seat and sending a signal when said weight is above a pre-set threshold; and g) actuator means for actuating said apparatus including a controller located in said upright tank, said controller being adapted to receive said signal and only actuating said flushing mechanism and said motor and pump when no signal is being received from said weight sensor.

2. The apparatus of claim 1, further including a proximity sensor on said upright tank and adapted to sense proximity of a hand or object and, responsive thereto, to send a further signal to said controller, said controller receiving such a further signal and, responsive thereto, provided a signal from said weight sensor is not concurrently received, actuating said flushing mechanism and activating said pump and motor for pre-set periods of time.

3. The apparatus of claim 2, wherein said pre-set periods of time comprise a first period of time allowing said motor to rotate said seat through two revolutions and a second period of time allowing said pump to operate during a first revolution of said seat.

4. The apparatus of claim 2, further including a level sensor adapted to sense level of disinfectant in said reservoir and an indicator coupled to said level sensor and adapted to indicate level of disinfectant therein.

5. The apparatus of claim 2, further including a timer connected to said controller, said controller activating said timer responsive to cessation of said weight sensor signal and automatically activating said flushing mechanism, motor and pump in the absence of receipt of a further signal from said proximity sensor within a pre-set time period measured by said timer.

6. The apparatus of claim 2, wherein said proximity sensor comprises a photoelectric eye.

7. The apparatus of claim 1, wherein said flow passage comprises a first passage adapted to convey disinfectant liquid over said arm, a second passage adapted to convey disinfectant liquid over said seat and a third passage adapted to convey disinfectant liquid under said seat and into said bowl.

8. The apparatus of claim 1, further including a power source for said controller.

9. The apparatus of claim 1, wherein said seat has a gear mounted circumferentially thereunder coupled to a gear on said drive shaft.

10. A self-sanitizing toilet seat cleaning apparatus for a toilet having a flushing mechanism, comprising:

a) a base having a bowl and a seat rotatably mounted above said bowl wherein the base is connected to an upright tank;

b) a motor mounted in said tank and having a rotary drive shaft coupled to said seat via a gear mounted circumferentially under said seat coupled to a gear on said drive shaft, whereby rotations of said drive shaft rotate said seat;

c) an arm extending from said tank and overlying said seat, said arm having a flow passage therethrough adapted to convey disinfectant liquid onto said seat and into said bowl, said flow passage comprising a first passage adapted to convey disinfectant liquid over said arm, a second passage adapted to convey disinfectant liquid over said seat and a third passage adapted to convey disinfectant liquid under said seat and into said bowl;

d) a reservoir of disinfectant liquid in said tank and fluidly connected to said flow passage via a pump, and a level sensor adapted to sense level of disinfectant in said reservoir and an indicator coupled to said level sensor and adapted to indicate level of disinfectant therein;

e) a wiper mounted under said arm and having a wiping surface configured in conformity with an upper surface of said seat;

f) a weight sensor sensing a weight on said seat and sending a signal when said weight is above a pre-set threshold;

g) actuator means for actuating said apparatus including a controller, said controller being adapted to receive said signal and only actuating said flushing mechanism and said motor and pump when no signal is being received from said weight sensor;

h) a proximity sensor on said tank and adapted to sense proximity of a hand or object and, responsive thereto, to send a further signal to said controller, said controller receiving such a further signal and, responsive thereto, provided a signal from said weight sensor is not concurrently received, actuating said flushing mechanism and activating said pump and motor for pre-set periods of time; and i) a timer connected to said controller, said controller activating said timer responsive to cessation of said weight sensor signal and automatically activating said flushing mechanism, motor and pump in the absence of receipt of a further signal from said proximity sensor within a pre-set time period measured by said timer.

11. The apparatus of claim 10, wherein said pre-set periods of time comprise a first period of time allowing said motor to rotate said seat through two revolutions and a second period of time allowing said pump to operate during a first revolution of said seat.

12. The apparatus of claim 10, further including a power source for said controller.

13. The apparatus of claim 10, wherein said proximity sensor comprises a photoelectric eye.

* * * * *